United States Patent [19]

Yamaguchi et al.

[11] 4,042,380

[45] Aug. 16, 1977

[54] GRAIN REFINED FREE-MACHINING STEEL

[75] Inventors: Yoshihiro Yamaguchi, Ashiya; Takashi Shimohata, Akashi; Sodai Kita; Yoshihide Fuchino, both of Kobe, Tsugio Kaneda, Akashi; Masashi Kawauchi; Sadayashi Furusawa; Shuzi Iwata, all of Kobe, all of Japan

[73] Assignee: Kobe Steel, Ltd., Kobe, Japan

[21] Appl. No.: 686,576

[22] Filed: May 14, 1976

[30] Foreign Application Priority Data

May 14, 1975 Japan ..... 50-57698

[51] Int. Cl.[2] ..... C22C 38/14; C22C 38/60

[52] U.S. Cl. ..... 75/124; 75/123 G; 75/123 H; 75/123 J; 75/126 F; 75/126 L; 75/128 P; 75/128 Z; 148/36

[58] Field of Search ..... 148/36; 75/124, 123 G, 75/123 H, 123 J, 123 K, 123 B, 126 F, 126 L, 126 C, 126 D, 128 P, 128 Z, 128 W, 128 F, 128 G

[56] References Cited

U.S. PATENT DOCUMENTS

| | | | |
|---|---|---|---|
| 2,789,069 | 4/1957 | Nachtman | 148/36 |
| 3,328,211 | 6/1967 | Nakamura | 148/36 |
| 3,544,393 | 12/1970 | Zanetti | 75/126 F |
| 3,634,073 | 1/1972 | Cutton et al. | 75/123 H |
| 3,661,537 | 5/1972 | Aronson et al. | 75/123 G |
| 3,666,570 | 5/1972 | Norchynsky et al. | 148/36 |
| 3,709,744 | 1/1973 | Goodman et al. | 148/36 |

FOREIGN PATENT DOCUMENTS

| | | | |
|---|---|---|---|
| 1,437,189 | 6/1966 | France | 148/36 |

*Primary Examiner*—Arthur J. Steiner
*Attorney, Agent, or Firm*—Oblon, Fisher, Spivak, McClelland & Maier

[57] ABSTRACT

This invention relates to a free-cutting steel that is used as a material for mechanical construction members be manufactured by machining as well as cold working.

There has been proposed resulfurized free-machining steels containing large amounts of sulfur to improve the machinability, as well as resulfurized free-machining steels containing sulfur and zirconium to improve machinability and cold workability. None of these steels, however, simultaneously satisfy the machinability cold workability and mechanical properties required of steels used for the construction of machines.

The present invention provides a steel comprising 0.08 to 0.6% of carbon, 0.35% or less of silicon, 0.3 to 1.5% of manganese, 0.04 to 0.15% of sulfur, 0.010 to 0.05% of aluminum, 0.01 to 0.08% of niobium, 0.008% or less of oxygen, 0.008% or less of nitrogen, wherein the amount of zirconium being 0.2 to 1.2 in terms of (Zr% $-2.9$x 0% $-6.5$x N%)/S%, the steel has a refined grain size and controlled sulfide morphology, and exhibits improved machinability, cold workability and mechanical properties.

5 Claims, 7 Drawing Figures

GRAIN REFINED FREE-MACHINING STEEL

DESCRIPTION OF THE PRIOR ART

Most of the members used for the construction of machines have been manufactured by machining operations. However in recent years, the widespread development of cold working such as cold forging has required a combination of cold working and machining operations to lower the cost of manufacturing the mechanical parts. It was, therefore, required for such structural members to provide a steel having various properties such as mechanical properties, cold workability and machinability. In general, however, these properties are of conflicting natures and are not compatible. For example, the resulfurized, free-machining steels containing large amounts of sulfur exhibit improved machinability but markedly deteriorated ductility (in the transverse direction) and deteriorated cold workability due to the formation of elongated sulfides in the rolling direction. To eliminate such disadvantages, some attempts were made to add zirconium to the resulfurized free-machining case hardening steels to control the shape of sulfides in an effort to improve the cold workability (forging property). Although these steels exhibit improved cold workability in addition to the machinability, in order to improve the cold workability zirconium has to be added in amounts far excess of the amount suited for controlling the grain size; therefore, even the formation of zirconium nitride does not work to refine the grain size due to zirconium nitride coarsening, and cannot improve mechanical properties such as ductility and Charpy impact resistance.

SUMMARY OF THE INVENTION

The present invention solves the aforementioned problems, and the primary object is to provide a steel having excellent machinability and cold workability.

The second object of the invention is to provide a steel having improved mechanical properties suited for use as the structural member of a machine in addition to having improved machinability and cold workability.

The first embodiment of the present nvention is a grain-refined free-machining steel comprising 0.08 to 0.6% of carbon, 0.35% or less of silicon, 0.3 to 1.5% of manganese, 0.04 to 0.15% of sulfur, 0.010 to 0.05% of aluminum, 0.01 to 0.08%, preferably 0.01 to 0.05% of niobium, 0.008% or less, preferably 0.0035% to 0.008% of oxygen, 0.008% or less of nitrogen, wherein the amount of zirconium being 0.2 to 1.2, preferably 0.5 to 1.2 in terms of (Zr% $-2.9\times$ 0% $-6.5\times$ N%)/S%.

The second embodiment of the invention is the grain-refined free-machining steel of the first embodiment but in which the shape of sulfides in the steel in terms of aspect ratio (length/width) is less than 6.0, and the size in terms of length $x$ width is 40 to 200 square microns in average.

The third embodiment of the invention is to provide a grain-refined free-machining of the first embodiment containing at least one 3% or less of nickel, 2% or less chromium, 1% or less molybdenum and 0.01% or less boron.

DETAILED DESCRIPTION OF THE PREFERRED EMBODIMENT

Figure 1:
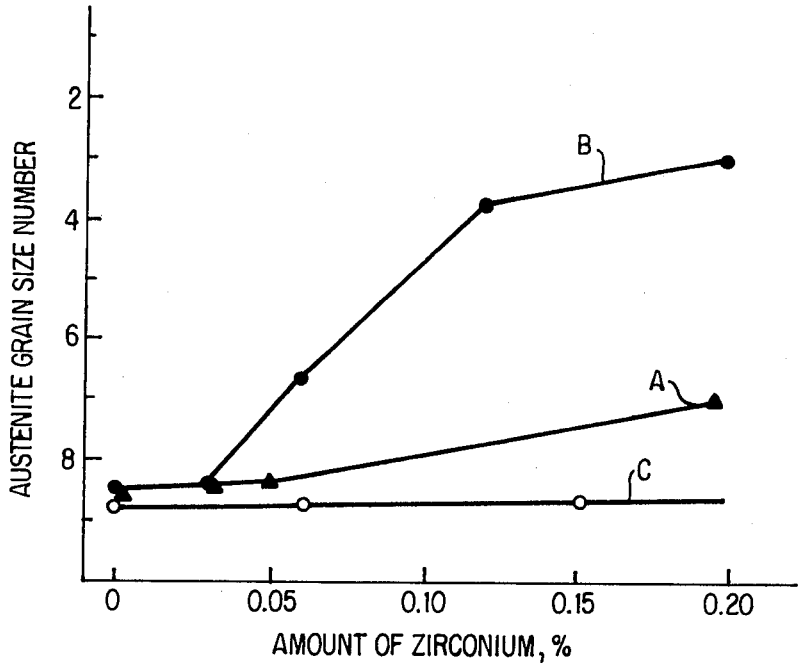
FIG. 1 is a diagram to show the effects of zirconium on the austenite grain size of the zirconium-containing resulfurized free-machining steel.

According to the present invention, the sulfides of zirconium that are effective in improving the machinability and cold workability are formed in the steel similar to conventional-zirconium-containing resulfurized free-machining steels, in order to prevent the adverse effects caused by the zirconium, the compositions of the steel is improved and adjusted, and the shape and size of the sulfides is controlled to improve the various properties required of steel for machine structural use.

It is generally known that non-metallic inclusions affect the machinability or mechanical properties and workability of the free-machining steels, and the relation between the shape of sulfides (l/w) and the cold working of the zirconium-containing resulfurized free-machining steels has already been reported (Iron and Steel, Vol. 60, No. 11, p. 158). The inventors of the present invention have conducted research concerning the zirconium-containing resulfurized free-machining steels, especially concerning proper shape and size of the sulfides containing zirconium in relation to the machinability.

Table 1 shows results concerning machinability of a resulfurized carbon steel (S45C —0.06%S) which was deoxidized by aluminum and thereafter zirconium was added. The steel was made into a ingot by an continuous casting (cooling rate of 17° C per minute) and by an ordinary casting method (cooling rate of 10° C per minute; 3-ton ingot) that was hot rolled to a round bar having a diameter of 80mm which was annealed, and subjected to turning cut tests performed with tools made from high speed tool steel. The shape and size (l/w, l $\times$ w) of about 200 sulfides were measured by means of optical microscope (magnitude 400).

Table 1: Machinability of S45C-0.06%S(-Zr) steel

TABLE 1

| Steel No. | Zr (%) | Machinability of S45C-0.06%S(-Zr) steel: average shapel/w | average size $l \times w\mu^2$ | Machinability V20 (m/min) | |
|---|---|---|---|---|---|
| 1 | — | 13.5 | 19 | 41 | Continuous casting material |
| 2 | 0.10 | 2.3 | 23 | 40 | " |
| 3 | — | 14.5 | 56 | 43 | Ordinary ingot |
| 4 | 0.091 | 3.2 | 68 | 51 | " |

*Cutting condition: Tool, SKH9, feed, 0.25 mm/rev notch, 1.5 mm, dry cutting
*V20: cutting velocity for tool life of 20 minutes As will be seen from Table 1, where the steel is cut with a tool made of a high speed steel, the shape and size of the sulfides greatly affect the machinability. Markedly improved machinability is seen in the steel of No. 4 of a size of about l/w 3.2, 1 × w 70 u² in which the sulfides are not excessively elongated and is large in size.

In this way, the machinability and cold workability are improved with a zirconium-containing resulfurized free-machining steel, it is advantageous to adjust the amount of zirconium in relation to sulfur, oxygen and nitrogen in the steel as will be mentioned later, and to employ an ordinary casting system (ingot should desirably be more than 1 ton) with a slow cooling rate than to employ a continuous casting system, whereby the size of the sulfides is controlled. But the employment of the ordinary casting system invites another problem.

FIG. 1 shows results (austenitizing temperature of 900° C, Gh method) of measuring the austenite grain sizes of a 80mm diametered hot rolled steel obtained from a zirconium containing resulfurized S45C—0.06%S (steel which is deoxidized with aluminum prior to adding zirconium and contains about 0.03% of aluminum) and to which is added 0.035% of niobium through a continuous casting or ordinary casting method. Referring to FIG. 1, the roughened austenite grain size due to the addition of zirconium with an ordinary casting material (symbol A) which was deoxidized with aluminum, does not give no particular problem. But with an ordinary casting material which was deoxidized with aluminum (symbol B), the austenite grain sizes are markedly roughened by the addition of zirconium. This is considered to be due to the fact that the cooling rate is slow as compared with the continuous casting material, and further, the addition of zirconium robs the steel of nitrogen, impairing the formation of aluminum nitride that is necessary for refining the grain size. Furthermore, the content of zirconium needed to improve the machinability and the cold workability, is considerably larger than the amount suited for refining the grain size; therefore, the formation of zirconium nitride can hardly contribute to refine the grain sizes. As will be apparent from the example of ordinary casting material which was deoxidized with aluminum (symbol B), the machinability of the material is markedly improved as shown in Table 1, the addition of zirconium causes the grain size to coarsen when the material is heat-treated at high temperatures such as tempering, which is a problem specific to a zirconium-containing resulfurized free-machining steel which was deoxidized with aluminum. Therefore, to slove such a problem, it was attempted to add niobium to the molten steel which has been deoxidized with aluminum and to which has been added zirconium. This is an ordinary casting material (symbol C) which has been deoxidized with aluminum and to which has been added niobium shown in FIG. 1. This casting material shows little roughened grain size caused by the addition of zirconium that was seen in the aforementioned ordinary casting material (symbol B) which was deoxidized with aluminum, and prevents the deterioration of mechanical properties.

Table 2 shows results concerning mechanical properties of zirconium containing resulfurized steel and zirconium-niobium containing resulfurized steel, each of which was deoxidized with aluminum prior to adding zirconium. As will be seen from Table 2, anisotropy of mechanical properties has been improved in respective steel due to the effect of zirconium, but in the steel A which does not contain niobium, the reduction of area in the longitudinal direction is remarkedly deteriorated because of grain size coarsening, while mechanical properties, especially reduction of area has been improved in steel B.

Table 2

Mechanical properties of test steels (S45C-0.06%S)

| Steel No. | Additional elements | tensile strength (Kg/mm²) longitudinal | tensile strength (Kg/mm²) transverse | Reduction of area longitudinal | Reduction of area transverse |
|---|---|---|---|---|---|
| A | Zirconium | 66.0 | 65.1 | 38.1 | 15.2 |
| B | Zirconium Niobium | 67.5 | 66.5 | 52.0 | 31.3 |

In this way, it is possible to normalize the presence of sulfides in the zirconium-containing resulfurized free-machining steels, and further the addition of niobium compensates the particle size of the zirconium-containing resulfurized free-machining steels that was inadequate with aluminum; it is then possible to prevent the deterioration of quality at the time of heat treatment and to improve the machinability. But in adding zirconium, sufficient attention should also be given to the effects of oxygen and nitrogen, not only to the effects by sulfur in the steel. That is, the addition of zirconium makes itself present in the sulfides in the steel, making it possible to adjust the shape of sulfides. Zirconium has very strong affinity to oxygen and to prevent the dessipation due to such strong affinity, it is necessary to deoxidize with aluminum prior to adding zirconium. Nevertheless it is impossible to avoid bonding of part of zirconium with oxygen and nitrogen, giving rise to the formation of harmful zirconium dioxide and zirconium nitride. Therefore, in a zirconium-containing resulfurized free-machining steel, it is necessary to adjust the oxygen and nitrogen content in the steel. Further, with regard to the cold workability and ductility in the transverse direction, where the zirconium content is to be considered in proportion to sulfur, the zirconium content have to be evaluated with its effective content, i.e., with the zirconium amount from which was subtracted zirconium that was bonded to oxygen and nitrogen to form zirconium dioxide and zirconium nitride. In other words, $$\text{Effective zirconium \%} = Zr\% - \frac{91.44}{32.00} \times O\% - \frac{91.44}{14.01} \times N\%$$

$$= Zr\% - 2.9 \times O\% - 6.5 \times N\%$$

Figure 2:
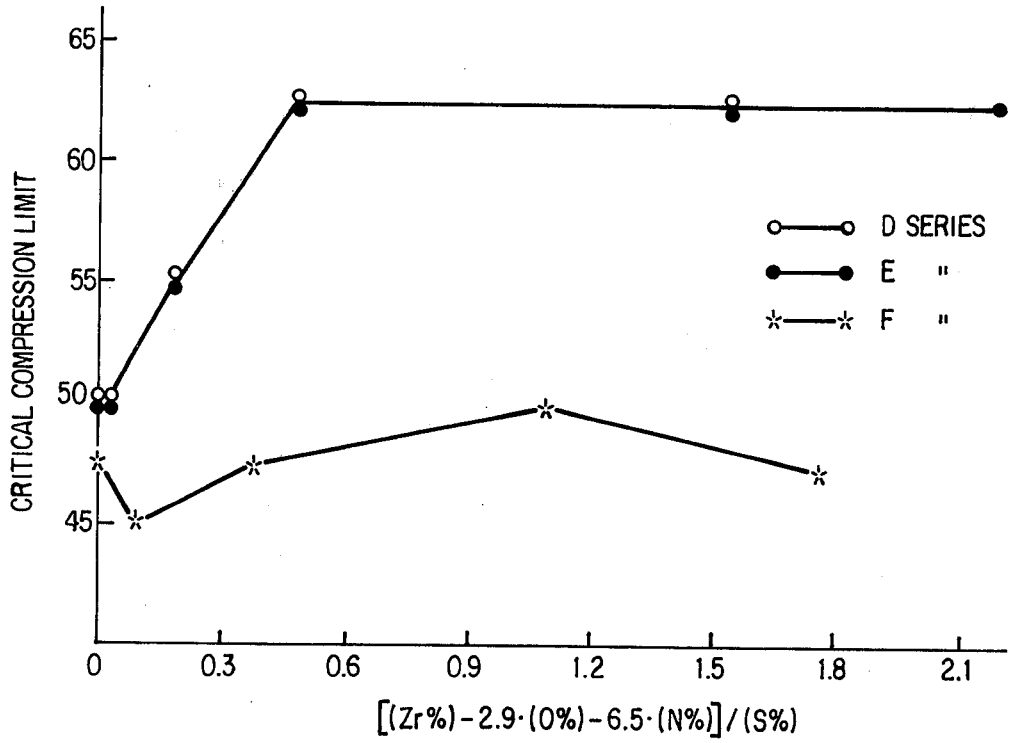
FIG. 2 is a diagram to show the effects of the effective amount of zirconium (Zr% $-2.9\times$ 0% $-6.5\times$ N%) on the cold forging property of the zirconium-containing resulfurized free-machining steel.

FIG. 2 shows the results of an S45C—0.06% S-Zr-containing spheroidized annealed steel in relation to the effective Zr/S in the steel and cold workability (testing method of critical compression limit is the same as that of Examples mentioned later), in which the contents of oxygen and nitrogen in the steel were divided into three levels (D series, oxygen = 0.004%, nitrogen = 0.004%, E series 0 = 0.005%, N = 0.007%, F series 0 = 0.009%, N = 0.009%). Referring to FIG. 2, in the steel of F series having large contents of oxygen and nitrogen, the cold workability is hardly improved regardless of the addition of zirconium. On the other hand, in the steels of D series and E series in which the contents of oxygen and nitrogen are smaller than those of F series, the cold workability is improved near the effective Zr/S ratio of 0.2; the improvement is stabilized over the range in which the effective Zr/S ratio is larger than 0.5.

Below are mentioned the reasons of restricting the numerical values in the steel.

Carbon content was limited to 0.08 to 0.6%, because the carbon content of less than 0.08% does not give any problem to the cold workability. Hence the lower limit was set to 0.08%. With the carbon content larger than 0.6%, the zirconium carbides are likely to be formed, offsetting the effects by the addition of zirconium. Also, the steel of the present invention is particularly useful as a high strength steel, in which case, it is desirable that the carbon content be larger than 0.3% to keep sufficient strength.

Silicon is necessary as an element to remove oxygen. But a silicon content of larger than 0.35% is accompanied by the increase of deformation resistance at the time of processing, resulting in decreased cold workability and machinability. Therefore, silicon should be contained in an amount less than 0.35%. Where the steel is used as a high strength steel, it is desirable to contain silicon in an amount of more than 0.1% to maintain the strength.

Manganese is an effective element to prevent cracking that might develop at the time of hot rolling, and is bonded to sulfur in the steel in the form of manganese sulfide. To increase the machinability, it is necessary to add manganese in an amount of at least 0.3%. If the content of manganese exceeds 1.5%, the deformation resistance increases excessively and deteriorates the machinability and cold workability. Therefore, the upper limit of the manganese content was restricted to 1.5%.

To improve the machinability, it is necessary to incorporate sulfur in an amount of more than 0.04%. But if the sulfur content exceeds 0.15%, the addition of zirconium cannot serve to prevent the deterioration of the area reduction in the transverse direction and cold workability caused by the incorporation of sulfur. Therefore, the upper limit of sulfur was limited to 0.15%.

Aluminum serves to remove oxygen. Where oxygen content is high in the molten steel prior to adding zirconium, there may develop the reduction of yield and increased streak flaws due to the addition of zirconium. Therefore, it is required to sufficiently deoxidize with aluminum prior to adding zirconium. It is necessary to add aluminum in an amount of at least 0.010%. The aluminum content in excess of 0.05% deteriorates the machinability. Therefore, the upper limit was limited to 0.05%.

It is necessary to incorporate niobium in an amount of more than 0.01% to control the grain size coarsening at the time of heat treatment where the shape and size of sulfides of the zirconium-containing resulfurized free-machining steel were controlled to improve the machinability as shown in FIG. 1. On the other hand, where niobium is contained in excess of 0.08%, there tends to develop large amounts of niobium carbonates, deteriorating the machinability and the cold workability. The upper limit was therefore limited to 0.08%. The upper limit is preferably limited to 0.05% because 0.05% of niobium sufficiently enables to control the grain size for steel except case hardening steel and from viewpoint of machinability.

Oxygen and nitrogen greatly affect the cold workability of the zirconium-containing resulfurized steel as shown in FIG. 2. If the contents of oxygen and nitrogen reach 0.009%, the addition of zirconium does not serve to improve the cold workability. Further taking into consideration the deterioration of mechanical propertes due to the formation of zirconium dioxide and zirconium nitride, it is essential to limit the contents of oxygen and nitrogen to less than 0.008%, respectively. Desirably, the sum of contents of these two should be limited to less than 0.012%.

Zirconium is an element essential to improve the machinability, ductility in the transverse direction and cold workability, and its content is determined in relation to the sulfur content in the steel. But the zirconium content should be evaluated in terms of effective zirconium content as mentioned earlier. And as shown in FIG. 2, the zirconium content should be more than 0.2, preferably more than 0.5 in terms of effective Zr/S ratio. If the ratio becomes too high, and the zirconium amount increases, there is a tendency for hard zirconium carbon sulfides to form, these adversely affect the machinability. Therefore, the upper limit of effective Zr/S ratio is set at 1.2.

Figure 7:
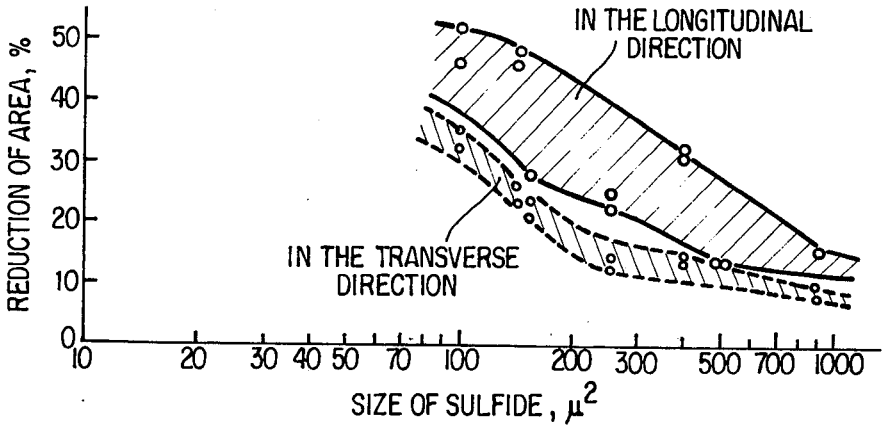
FIG. 7 shows the relationship between the size of sulfide and reduction of area in tensile test of zirconium-niobium containing resulfurized steel.
Figure 6:
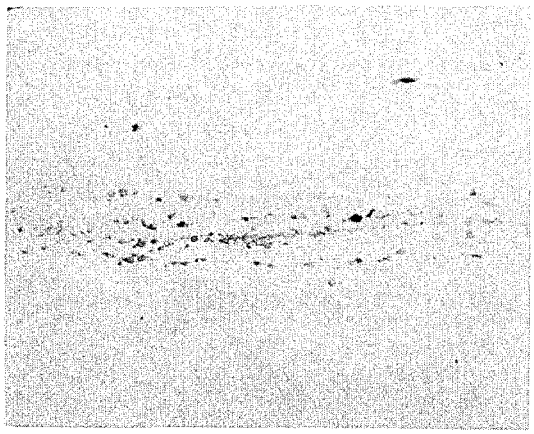
FIG. 6 shows a photograph of streak flaws formed in the steel.

Next, the shape and size of sulfides greatly affect the machinability, ductility in the transverse direction and cold workability of the zirconium-containing resulfurized steel. In view of ductility in the transverse direction and cold workability, it is desirable that the sulfides are not elongated; it is necessary that l/w is less than 6. On the other hand, from the viewpoint of machinability, the above requirements only are not sufficient as shown in Table 1. Investigation of the size of sulfides proved for the machinability, the above requirements only are not sufficient as shown in Table 1. Investigation of the size of sulfides proved that the machinability is improved with the size $l \times w$ of more than 40 square microns when machined with a tool of a high speed steel. As mentioned above, it is preferable for improving machinability of steel to increase the size of sulfides, while the increase of the size of sulfides tends to deteriorate mechanical properties, especially reduction of area of such steels containing high amount of sulfur as free-machining steel. The relationship between reduction of area of zirconium-niobium containing resulfurized S45C—0.01%S steel and the size of sulfide is shown in FIG. 7, from which it will be apparent that the value of reduction of area is decreasing according to the increase of the size of sulfide, the upper limit is therefore limited to 200 $\mu^2$. Also, at the time of machining with a carbide tool, the addition of zirconium works to reduce the oxides of the type of $Al_2O_3$ that are harmful to the machinability of an aluminum killed steel and forms oxides of the type of $ZrO_2$ that are effective to prevent the wear of carbide tool. Therefore, the addition of zirconium helps improve the life of the carbide tool. In order to form effective oxides of the type of zirconium oxide, oxygen should preferably be incorporated in an amount of more than 0.0035%, and more preferably in an amount of 0.0035 to 0.0080% by taking into consideration the aforesaid cold workability.

The present invention is not limited to the carbon steels but is also applied to low alloy steels containing more than one 3% or less of nickel, 2% or less chromium, 1% or less molybdenum, and 0.01% or less boron, to obtain similar properties.

Examples of the present invention are illustrated below together with Comparative Examples.

Table 3 shows chemical compositions of steels used for testing, and the shape and size of sulfides. The fundamental steel is a plain carbon steel S45C used for machine structure, and the comparative steel is resulfurized free-machining steel (B1). The steels (C1, C2) of the present invention incorporate components shown in appropriate amounts.

Table 3

Chemical compositions, shape and size of sulfides of steels tested.

| Steel Classification | Symbol | Chemical compositions (%) C | Si | Mn | P | S | Al | Zr | Nb | ΣN | ΣO | Effective Zr/S* | Sulfides 1/w | 1 × *μ² |
|---|---|---|---|---|---|---|---|---|---|---|---|---|---|---|
| Fundamental steel | A1 | 0.45 | 0.26 | 0.81 | 0.015 | 0.020 | 0.031 | — | — | 0.0065 | 0.0070 | — | — | — |
| Comparative steel | B1 | 0.46 | 0.25 | 0.79 | 0.019 | 0.065 | 0.029 | — | — | 0.0070 | 0.0068 | — | 14.5 | 56 |
| Steels of the invention | C1 | 0.44 | 0.25 | 0.81 | 0.018 | 0.067 | 0.035 | 0.091 | 0.035 | 0.0067 | 0.0055 | 0.47 | 3.2 | 68 |
| | C2 | 0.46 | 0.27 | 0.80 | 0.017 | 0.070 | 0.033 | 0.103 | 0.038 | 0.0070 | 0.0056 | 0.59 | 3.0 | 70 |

*Effective Zr/S = (Zr% − 2.9 × O% − 6.5 × N%)/S%

After casting into ordinary ingot, the test steels were hot rolled to a steel bar of a diameter of 80 mm.

Table 4 shows the mechanical properties of the testing steels of Table 2 subjected to normalized condition (850° C × 2 hrs. cooled in air), as well as the cold workability of the testing steels subjected to spheroidized annealed condition. (740° C × 3 hrs. + 700° C × 4 hrs, cooled gradually). The cold forging property was evaluated by upsetting a test piece of a size of 20 mm in diameter and 30 mm in length by way of a 300-ton press with grooved dies and by determining the critical compression limit defined by the following relation, $$(H_o - H)/H_o \times 100\%$$

wherein $H_o$ is the initial critical height 30 mm of the test piece, and H is the height of the test piece without cracking.

Table 4

Mechanical properties and cold workabilities of the test steels.

| Steel Classification | Symbol | Tensile strength (kg/mm²) longitudinal | transverse | Reduction of area longitudinal | transverse | Critical compression limit (%) |
|---|---|---|---|---|---|---|
| Fundamental steel | A1 | 66.3 | 65.0 | 51.0 | 37.3 | 65.0 |
| Comparative steel | B1 | 67.1 | 65.9 | 50.3 | 10.5 | 50.0 |
| Steels of the invention | C1 | 67.7 | 66.0 | 51.2 | 29.5 | 62.5 |
| | C2 | 67.5 | 66.5 | 52.0 | 31.3 | 62.5 |

As will be apparent from Table 3, the comparative steel (B1) containing sulfur exhibits markedly reduced reduction of area in the transverse direction and critical compression limit as compared to the fundamental steel. But the steels (C1, C2) of the present invention containing sulfur in an amount near to that of the comparative steel (B1) exhibit markedly improved reduction of area in the transverse direction and critical compression limit.

Figure 3:
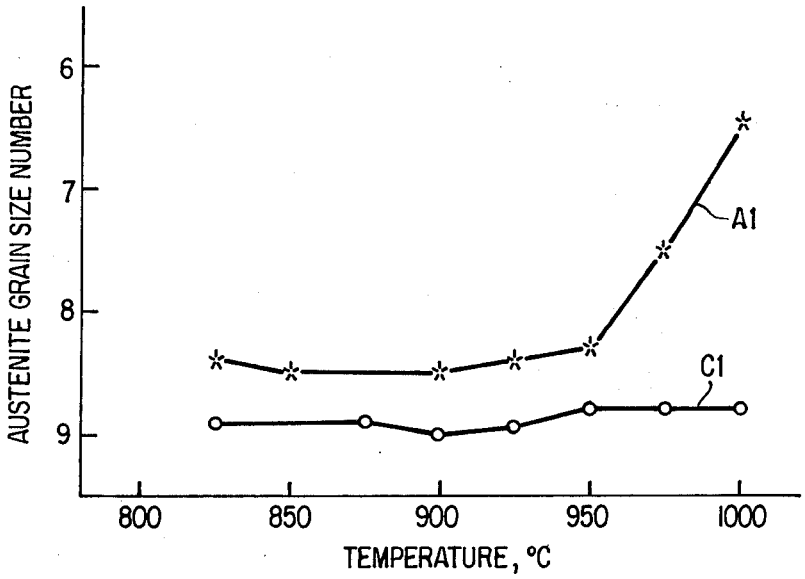
FIG. 3 is a diagram to show the austenite grain size US. temperature curve (Gh method: JIS-G0551) of the steel of the present invention and of a plain carbon steel.

FIG. 3 shows the relationship between the austenite grain size and temperature (GL method), in which the steel of the present invention is stable up to high temperature regions and is excellent in refining grain size.

Figure 4:
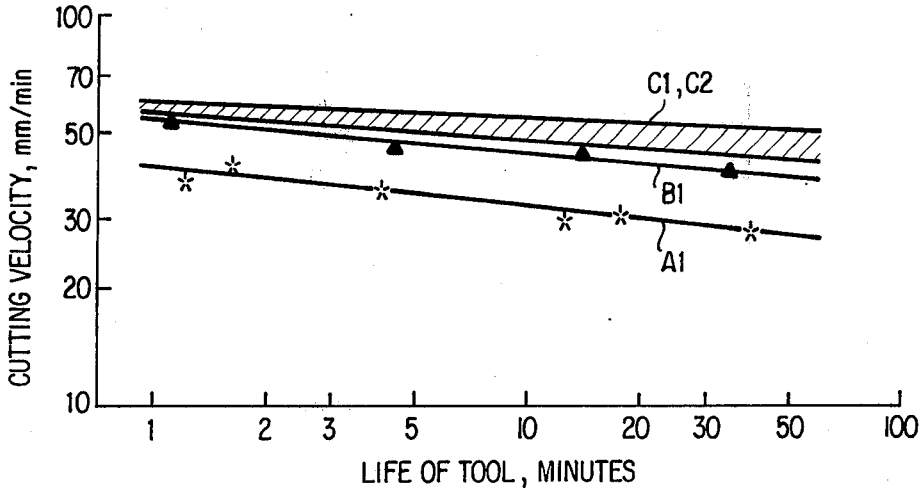
FIG. 4 shows the life of a high speed steel tool used in the turning tests of the steel of the present invention, plain carbon steel and ordinary resulfurized steel.
Figure 5:
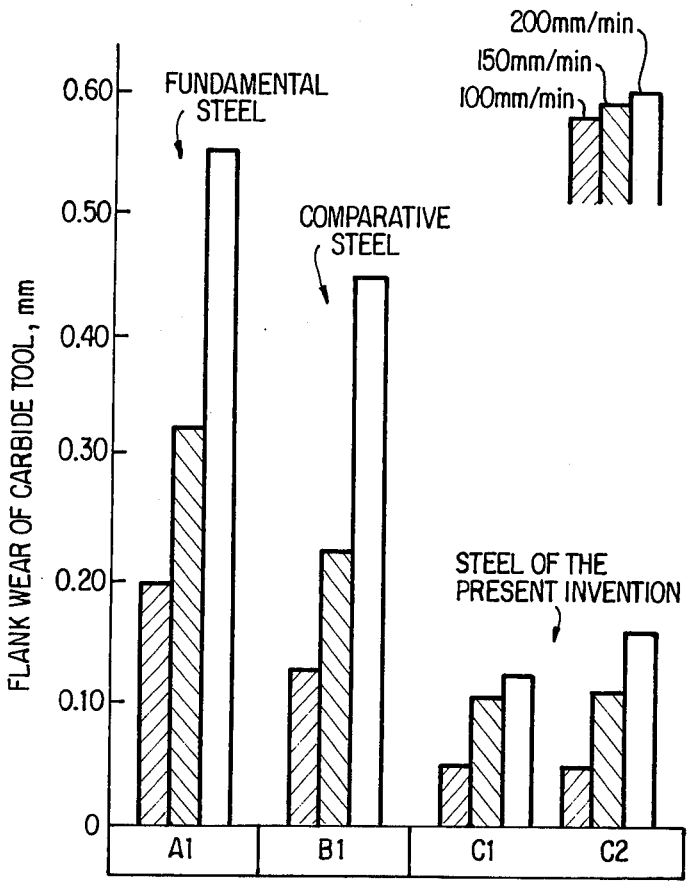
FIG. 5 is a diagram to show the flank wear of the carbide tool used in the turning tests of the steel of the present invention, plain carbon steel and ordinary resulfurized steel.

FIG. 4 shows the results of a life of high speed tool in turning tests under the cutting conditions using a high speed steel tool SKH9, feeding at a rate of 0.25 mm per revolution, notch of 1.5 mm, dry cutting, and until the cutting was completely impossible. FIG. 5 further shows the amount of tools worn out when cutting was conducted using carbide tools P10, under the conditions of a feeding rate of 0.25 mm per revolution, notch of 1.5 mm, dry cutting, and setting the cutting speed to 100, 150, 200 meters per minute, respectively for 30 minutes.

As FIG. 4 and FIG. 5 indicate, the steels of the present invention exhibit excellent machinability over wide range of cutting speeds in turning tests used high speed steel tool and carbide tools, as compared to the fundamental steel and the comparative steel.

As mentioned in the foregoing, the present invention provides zirconium containing resulfurized free-machining steel having more improved machinability, refining the grain size, solving the problem of deteriorated mechanical properties, and further exhibiting excellent ductility in the transverse direction and cold workability.

What is claimed is:

1. A grain-refined free-machining steel consisting essentially of 0.08 to 0.6 percent carbon, 0.35 percent or less silicon, 0.3 to 1.5 percent manganese, 0.04 to 0.15 percent sulfur, 0.01 to 0.05 percent aluminum, 0.01 to 0.08 percent niobium, 0.0035 to 0.008 percent oxygen, 0.008 percent or less nitrogen, zirconium, and the balance iron wherein the ratio of the effective zirconium to sulfur is from 0.2 to 1.2 and the amount of effective zirconium is:

$$\text{effective zirconium} = Zr\% - 2.9 \times 0\% - 6.5 \times N\%$$

and wherein the ratio length to width of the sulfides in said steel averages 6.0 or less and the size of said sulfides in terms of length X width averages from 40 to 200 square microns.

2. The grain-refined free-machining steel of claim 1, wherein the sum of amounts of oxygen and nitrogen is 0.012% or less.

3. The grain-refined free-machining steel of claim 1, wherein niobium is incorporated in an amount of from 0.01 to 0.05%.

4. The grain-refined free-machining steel of claim 1, wherein the amount of zirconium ranges from 0.5 to 1.2 in terms of (Zr% − 2.9 × 0% − 6.5 × N%)/S%.

5. The grain-refined free-machining steel of claim 1, wherein there is further incorporated at least one kind of 3% or less nickel, 2% or less chromium, 1% or less molybdenum, and 0.01% or less boron.

* * * * *

UNITED STATES PATENT AND TRADEMARK OFFICE

CERTIFICATE OF CORRECTION

PATENT NO. : 4,042,380

DATED : August 16, 1977

INVENTOR(S) : Yoshihiro Yamaguchi et al

It is certified that error appears in the above-identified patent and that said Letters Patent are hereby corrected as shown below:

Please delete:

"[75] Inventors: Yoshihiro Yamaguchi, Ashiya; Takashi Shimohata, Akashi; Sodai Kita; Yoshihide Fuchino, both of Kobe, Tsugio Kaneda, Akashi; Masashi Kawauchi; Sadayashi Furusawa; Shuzi Iwata, all of Kobe, all of Japan"

and insert therefor:

--[75] Inventors: Yoshihiro Yamaguchi, Ashiya; Takashi Shimohata, Akashi; Sodai Kita; Yoshihide Fuchino, both of Kobe, Tsugio Kaneda, Akashi; Masashi Kawauchi; Sadayoshi Furusawa; Shuzi Iwata, all of Kobe, all of Japan--

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,042,380

DATED : August 16, 1977

INVENTOR(S) : YAMAGUCHI ET AL.

It is certified that error appears in the above-identified patent and that said Letters Patent are hereby corrected as shown below:

Abstract, line 2, after "members" insert -- which may --;

Abstract, line 9, after "machinability" insert -- , --;

Column 1, line 29, after "far", insert -- in --;

Column 1, line 44, delete "nvention" and insert therefor -- invention --;

Column 1, line 60, after "free-machining" insert -- steel --

Column 1, line 61, after "one" insert -- of --; and after "less", delete "of";

Column 2, line 22, delete "EMBODIMENT", and insert therefor -- EMBODIMENTS --;

Column 2, line 26, delete "conventional-zirconium- containing", and insert therefor -- conventional zirconium-containing --

Column 2, line 28, delete "compositions' and insert

UNITED STATES PATENT AND TRADEMARK OFFICE

CERTIFICATE OF CORRECTION

PATENT NO. : 4,042,380

DATED : August 16, 1977

INVENTOR(S) : YAMAGUCHI ET AL.

It is certified that error appears in the above-identified patent and that said Letters Patent are hereby corrected as shown below:

therefor -- composition --;

Column 2, line 30, delete "is", and insert therefor -- are-

Column 2, line 47, delete "a" and insert therefor -- an --; and after "by", delete "an";

Column 3, line 6, after "and", delete "is" and insert there for -- are --;

Column 3, line 29, delete "no", and insert therefor -- any

Column 3, line 51, delete "slove" and insert therefor -- solve --;

Column 4, line 5, delete "has" and insert therefor -- have --;

Column 4, line 30, delete "dessipation" and insert therefor -- dissipation --;

Column 4, line 41, delete "have" and insert therefor -- has --

UNITED STATES PATENT AND TRADEMARK OFFICE

CERTIFICATE OF CORRECTION

PATENT NO. : 4,042,380

DATED : August 16, 1977

INVENTOR(S) : YAMAGUCHI ET AL.

It is certified that error appears in the above-identified patent and that said Letters Patent are hereby corrected as shown below:

Column 6, line 62, after "one", insert -- of --;

Column 7, line 49, delete "3", and insert therefor -- 4 --;

Column 7, line 62, delete "a";

Column 8, line 5, delete "used", and insert therefor -- using --;

Column 8, line 10, delete "$1 \times w_{\mu}^{2}$", and insert therefor -- $1 \times w\mu^{2}$ --;

Column 8, line 63, delete "amount" and insert therefor -- ratio --; and after "of" insert -- effective --; and after "zirconium" insert -- to sulfur--;

Column 8, line 64, delete entire line;

Column 8, line 66, delete "kind".

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*